US008435015B2

(12) United States Patent
Brookbank et al.

(10) Patent No.: US 8,435,015 B2
(45) Date of Patent: May 7, 2013

(54) HEAT TRANSFER THROUGH THE ELECTRICAL SUBMERSIBLE PUMP

(75) Inventors: Earl B. Brookbank, Claremore, OK (US); Suresha R. O'Bryan, Joplin, MO (US)

(73) Assignee: Baker Hughes Incorporated, Houston, TX (US)

( * ) Notice: Subject to any disclaimer, the term of this patent is extended or adjusted under 35 U.S.C. 154(b) by 445 days.

(21) Appl. No.: 12/416,808

(22) Filed: Apr. 1, 2009

(65) Prior Publication Data

US 2010/0150739 A1 Jun. 17, 2010

Related U.S. Application Data

(60) Provisional application No. 61/138,060, filed on Dec. 16, 2008.

(51) Int. Cl.
*F04B 39/06* (2006.01)

(52) U.S. Cl.
USPC ..... 417/369; 417/366; 166/104; 166/302; 310/52

(58) Field of Classification Search ..... 417/53, 417/366, 367, 368, 369; 165/109.1; 166/104, 166/302; 310/52
See application file for complete search history.

(56) References Cited

U.S. PATENT DOCUMENTS

| | | | | |
|---|---|---|---|---|
| 2,556,435 | A | 6/1951 | Moehrl et al. | |
| 3,242,360 | A | 3/1966 | Carle | |
| 3,671,786 | A | 6/1972 | Jones | |
| 4,286,185 | A | 8/1981 | Erickson | |
| 4,685,867 | A | 8/1987 | Patun et al. | |
| 5,554,897 | A | 9/1996 | Martin et al. | |
| 5,736,059 | A * | 4/1998 | Mackelvie | 210/774 |
| 6,364,013 | B1 | 4/2002 | Watson et al. | |
| 7,188,669 | B2 * | 3/2007 | Bullock et al. | 166/105 |
| 7,299,873 | B2 | 11/2007 | Hartman et al. | |
| 7,492,069 | B2 | 2/2009 | Knox et al. | |
| 8,037,936 | B2 | 10/2011 | Neuroth et al. | |
| 2005/0074344 | A1 * | 4/2005 | Gozdawa | 417/423.12 |
| 2007/0143914 | A1 * | 6/2007 | Shirai et al. | 4/420.2 |
| 2009/0269224 | A1 | 10/2009 | Hunt et al. | |

OTHER PUBLICATIONS

One sheet from a brochure of Byron Jackson identified as Bulletin No. 2560-6A, brochure published in the 1990's (unknown specific date).

* cited by examiner

*Primary Examiner* — Charles Freay
*Assistant Examiner* — Patrick Hamo
(74) *Attorney, Agent, or Firm* — Bracewell & Giuliani LLP

(57) ABSTRACT

The motor of an electrical submersible pump generates a significant amount of heat that can be removed by transferring it to the well production fluid. The motor housing may have turbulators that increase the turbulence of the production fluid to increase the rate of heat transfer. The turbulators are designed for manufacturability and maintenance.

14 Claims, 5 Drawing Sheets

HEAT TRANSFER THROUGH THE ELECTRICAL SUBMERSIBLE PUMP

CROSS-REFERENCE TO RELATED APPLICATIONS

This application claims priority to provisional application 61/138,060, filed Dec. 16, 2008.

FIELD OF THE INVENTION

This invention relates in general to well pumps, and in particular to a well pump housing varying geometry to increase heat transfer.

BACKGROUND

Referring to FIG. 1, a well contains a casing 10. The casing 10 lines a wellbore (not shown) and is cemented in place. A pump 12 is located inside the casing 10, frequently at great depths below the surface of the earth. The pump is used to pump production fluid from the depths of the well up to the surface. A shaft (not shown) connects pump 12 to motor 16. Production fluid enters the pump inlet 17 and is pumped out through tubing 18.

The motor tends to produce heat that must be removed to prolong the life of the motor. External devices used to decrease heat create additional costs. External cooling devices, for example, use a coolant pump above the well and coolant lines running through the wellbore to the pump. These cooling devices cool the pump by circulating the coolant through the pump and transferring the coolant back to the surface. The coolant pump, coolant lines, and coolant all create additional costs. Furthermore, the coolant lines may interfere with well operations.

The motor-pump assembly is located inside a wellbore so it is desirable to transfer heat to the production fluid that is flowing past the motor. It is common to arrange the pump and motor such that the production fluid flows past the motor on its way to the pump. Heat is transferred to the production fluid and carried away as the production fluid moves to the surface. It is desirable to increase the rate of heat transfer from the motor to the production fluid.

One method to increase the rate of heat transfer is to increase the surface area of the pump that is in contact with the production fluid. This can be done by elongating the motor housing or attaching a shroud to the pump or motor. The production fluid flows between the motor and the shroud so that heat can move from both the motor and the shroud into the production fluid. Other devices, such as fins, may be used to increase surface area of the motor. All of these methods of increasing surface area are limited by the small space available inside the wellbore. Furthermore, there is a problem with fins breaking off and creating blockages within the production fluid flow.

Fins may be used to create vortices within the production fluid. The vortices in the production fluid increase the rate of heat transfer between the motor and the production fluid. Unfortunately, the vortice-inducing fins, like fins used to increase the surface area, can break off and obstruct fluid flow. Fins also make pump manufacture and maintenance more difficult because they interfere with the assembly, disassembly, and the movement within the wellbore of the pump assembly.

Assembly is more difficult because the fins must be installed on the motor before the motor is inserted into the cylindrical shroud. The difficulty arises because the fins tend to interfere with the fit between the motor and the shroud. The height of the fins must be limited to allow for insertion, but even with a limited height they can still catch on other fins, the sides of the motor, or the wellbore. If the fin is attached to the motor, for example, there must be a gap between the outer edge of the fin and the shroud to allow clearance during assembly. Clearance issues also make it extremely difficult to attach fins to both the motor and the shroud in the same assembly because the fins interfere with each other during assembly and disassembly. Furthermore, fin clearance issues prevent the fin from spanning the entire gap between the shroud and the motor.

It is also difficult to perform maintenance on the motor when fins are attached directly to the motor housing because the fins make it more difficult to put the motor on a flat surface or hold it in a vice. In addition to increased assembly and maintenance costs, there is a cost associated with manufacturing and attaching the fins to the shroud and pump. It is desirable to increase the rate of heat transfer without incurring the disadvantages of fins.

DETAILED DESCRIPTION

Figure 1:
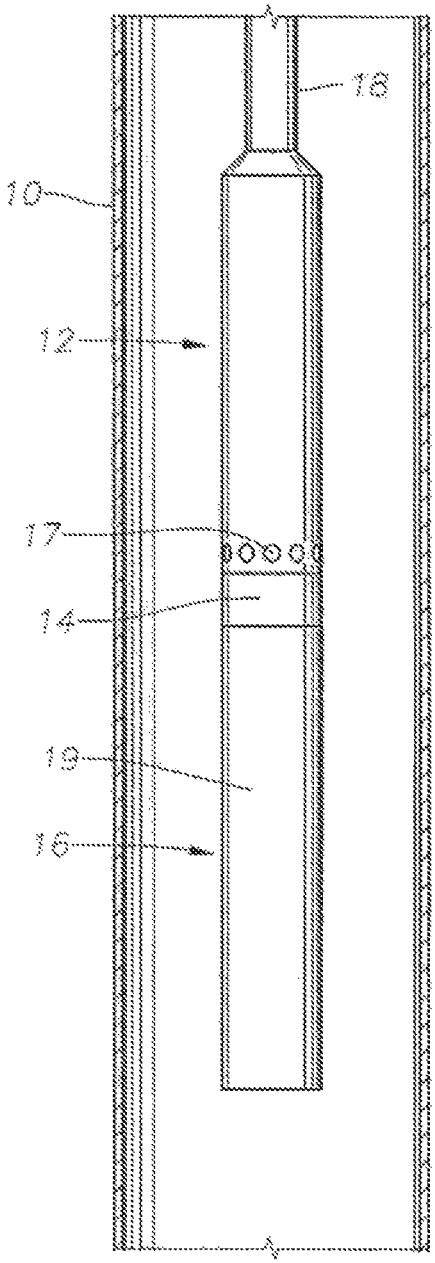
FIG. 1 is a schematic view of prior art pump assembly in a wellbore.

Referring to FIG. 1, the casing 10 is shown in a vertical orientation, but it could be inclined. A pump 12 is suspended inside casing 10 and is used to pump fluid up from the well. The pump 12 may be centrifugal or any other type of pump and may have an oil-water separator or a gas separator. The pump 12 is driven by a shaft (not shown), operably connected to a motor 16. A seal section 14 is mounted between the motor 16 and pump 21. The seal section reduces a pressure differential between lubricant in the motor and well fluid. The motor 16 is encased in a housing 19. Preferably, the fluid produced by the well ("production fluid") flows past the motor 16, enters an intake 17 of pump 12, and is pumped up through a tubing 18. Preferably, the motor 16 is located below the pump 12 in the wellbore. The production fluid may enter the pump 12 at a point above the motor 16, such that the fluid is drawn up, past the motor housing 19 of the motor 16, and into the pump inlet 17.

The rate of heat transfer is determined by the equation $Q=h(A)(T)$; where $Q$=rate of heat transfer, $h$=the heat transfer coefficient, A=surface area, and T=the difference in temperature (in this case, T is the difference in temperature between the motor housing 19 and the production fluid).

Figure 2:
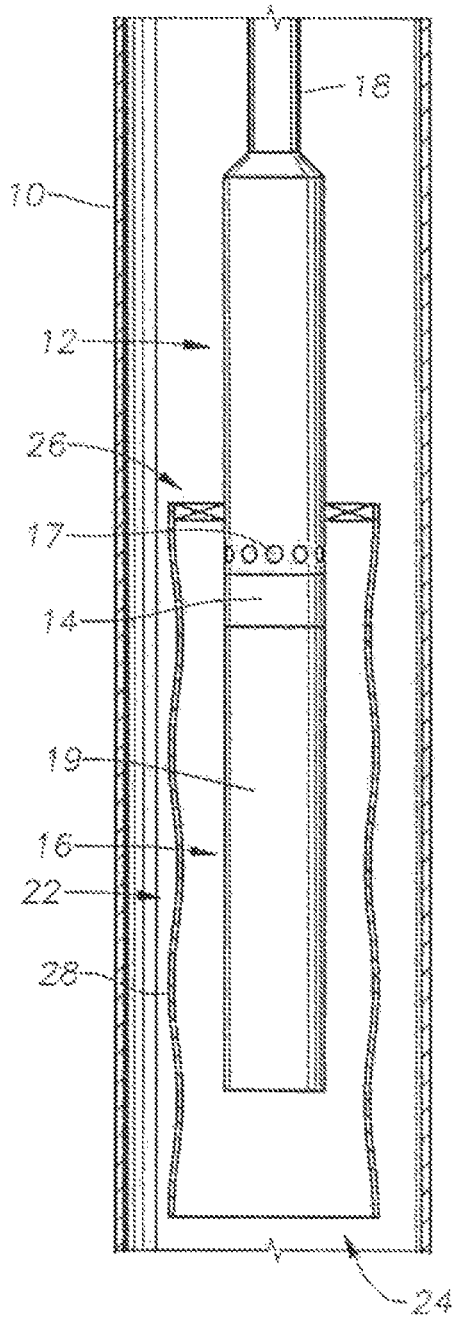
FIG. 2 is a sectional view of the pump assembly of FIG. 1 with a shroud having an irregular-shaped side wall.

Referring to FIG. 2, a shroud 22 is mounted around motor 16 to increase the velocity of fluid flowing past the motor housing 19. The shroud 22 has an open lower end 24 and an upper end 26 sealingly secured around pump 12 above intake 17. The shroud 22 may be secured by other means and in other locations. The shroud 22 reduces the cross sectional area of the path of fluid flow and thus increases velocity. Increased velocity, or changing velocity, or both, will generally increase turbulence, which in turn increases the heat transfer coefficient (h) of the production fluid flow across the surface of the motor housing 19. A device that increases turbulence in the fluid flow is referred to herein as a "turbulator."

A turbulator may be a feature on a shroud, on the motor housing, or any other part of the motor. As shown in FIG. 2, the turbulator comprises shroud 22, which may have an irregular sidewall 28 shape, and thus creates pockets of increased velocity and turbulence as the production fluid flows within shroud 22. In FIG. 2, the sidewall 28 of the shroud 22 is formed into a pattern that is sinusoidal when viewed in cross section. The period of each rounded peak and valley may vary considerably. For example, the length of each curve could be much shorter than the length of the motor. The annular flow area varies along the length of the motor 16 as a result.

Figure 3:
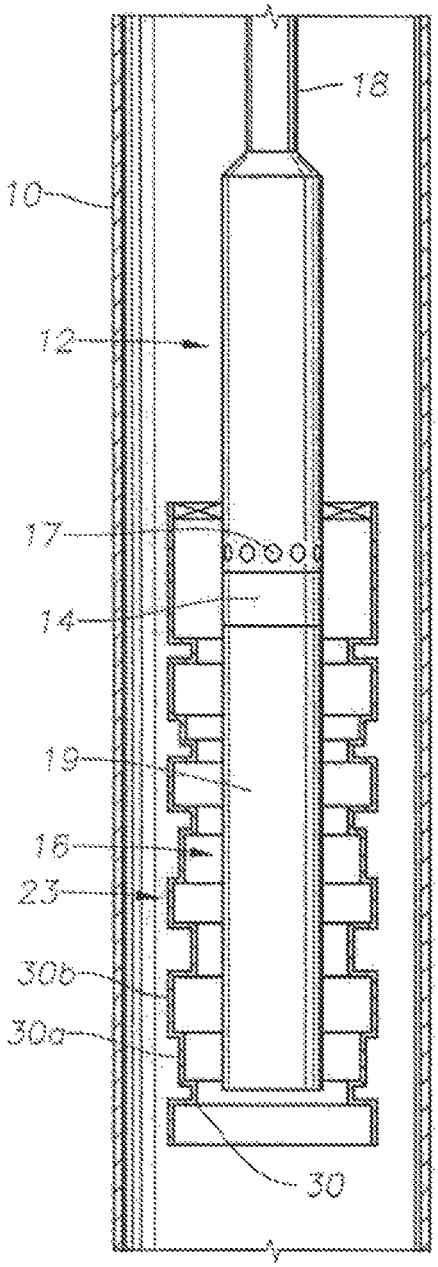
FIG. 3 is a sectional view of a pump assembly with a "stair-step" shroud attached.

Referring to FIG. 3, turbulence is increased by using a "stair-step" shaped shroud 23 as the turbulator. The production fluid develops a higher velocity, and thus more turbulence, as the inner diameter ("ID") of the shroud 23 decreases. The laminar flow is further disrupted as the fluid flows past the corners 30 of the indentations in the shroud 23. In one example embodiment, the motor housing 19 has a 7.25" diameter and the shroud 22 has a 10.75" diameter, leaving a 1.75" maximum gap between the motor housing 19 and the shroud 23. The shroud 23 could constrict to allow, for example, a 0.5" clearance between the motor housing 19 and shroud 23, thus increasing the velocity. The steps of the shroud 23 may be various lengths measured in the direction of the shroud 23 axis, including, for example, 0.5" or 1". For example, section 30*a* has a smaller inner diameter and shorter axial length than section 30*b*. Steps also could have a uniform, corrugated appearance such that, for example, every other step has the same inner diameter.

Another embodiment of the stair-step shroud 23 is an asymmetrical stair step (not shown) in which the inner diameter varies in one or more quadrants of the shroud 23. This asymmetrical shape further disrupts laminar flow by creating pockets of higher and lower pressure from side-to-side across the motor housing 19 thus promoting lateral flow of the production fluid.

Figure 4:
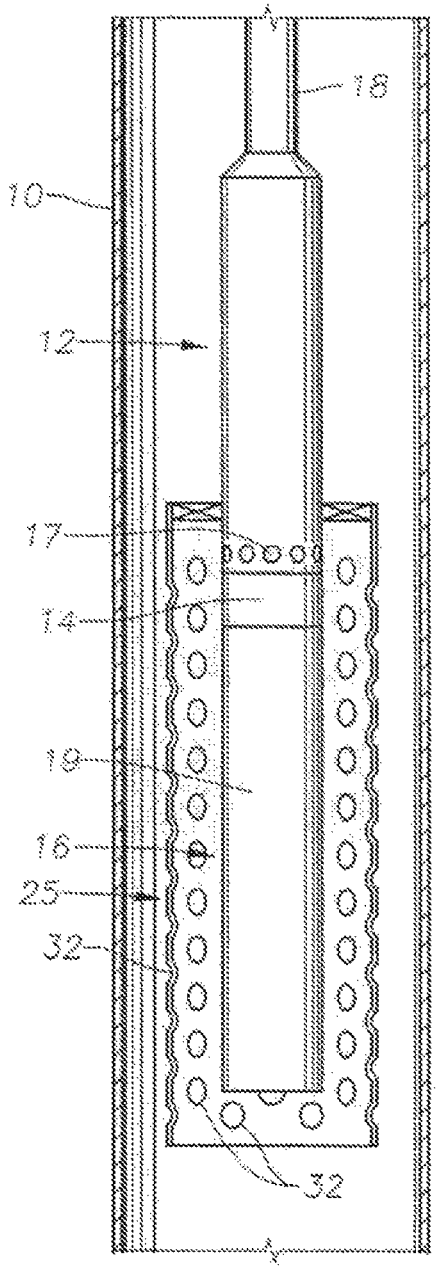
FIG. 4 is a sectional view of a pump assembly with dimples on the shroud.

Referring to FIG. 4, the turbulator comprises multiple dimples 32 on the shroud 25. The dimples 32 are indentations or protrusions in the interior face of the shroud 25. The size of the indentations 32 may vary and could be, for example, made from a ¼" or ½" diameter round punch driven to a ⅛" depth. Dimples 32 could also have a significantly larger or smaller diameter and be driven to a greater or lesser depth. Furthermore, the dimples 32 may have different shapes such as round, oval, square, and the like. The dimples 32 may be distributed about the surface in a symmetric pattern or they may be placed randomly. The dimples 32 may be concave or convex in relation to the interior of the shroud 25. The dimples 32 increase the turbulence of the production fluid and thus increase the rate of heat transfer from the motor housing 19 to the production fluid. The dimples give the shroud a textured surface. Other kinds of textured surfaces may also be used to increase turbulence. Furthermore, the dimples 32 are an inexpensive design modification and are not detrimental to the maintenance, handling, and installation of the motor 16. The dimples 32 may be used alone or in combination with other devices that increase production fluid turbulence.

Figure 5:
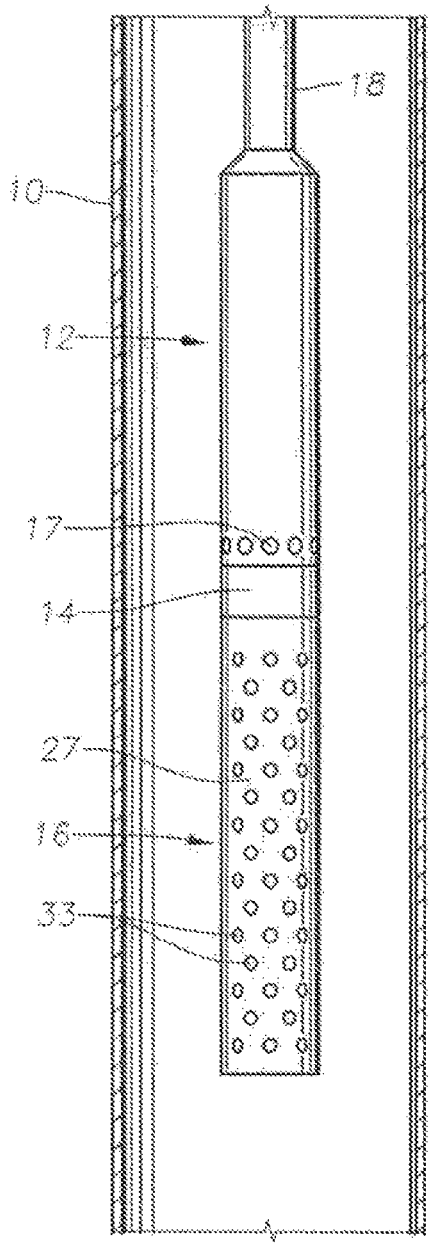
FIG. 5 is a sectional view of a pump assembly with dimples on the pump motor housing.

Referring to FIG. 5, the turbulator comprises multiple dimples 33 on the motor housing 16. The dimples 33 are indentations or protrusions in the exterior surface of the motor housing 27. The size of the indentations 33 may vary and could be, for example, made from a ¼" or ½" diameter round punch driven to a ⅛" depth. Dimples 33 could also have a significantly larger or smaller diameter and be driven to a greater or lesser depth. Furthermore, the dimples 33 may have different shapes such as round, oval, square, and the like. The dimples 33 may be distributed about the surface in a symmetric pattern or they may be placed randomly. The dimples 33 may be concave or convex in relation to the exterior of the motor housing 27 and may be used regardless of whether a shroud is used. The dimples 33 increase the turbulence of the production fluid and thus increase the rate of heat transfer from the motor housing 27 to the production fluid. The dimples give the housing a textured surface. Other kinds of textured surfaces may also be used to increase turbulence. Furthermore, the dimples 33 are an inexpensive design modification and are not detrimental to the maintenance, handling, and installation of the motor 16. The dimples 33 may be used alone or in combination with other devices that increase production fluid turbulence.

Figure 6:
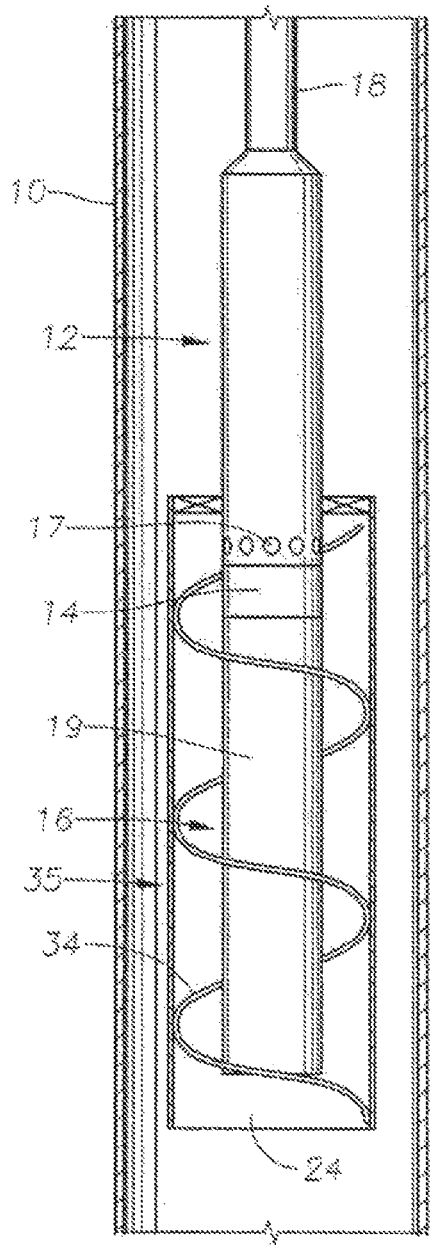
FIG. 6 is a sectional view of a pump assembly with a wire coil attached to the inside of the shroud.

Referring to FIG. 6, a wire coil 34 may be attached to the inside of a shroud 35 to form a turbulator. The presence of the helical coil 34 serves to disrupt the laminar flow of the production fluid and thus increase the rate of heat transfer. The coil 34 can be installed in any variety of positions. For example, it could be attached to the shroud 35 in one or more places as it loops around the motor housing 19, or it could use spacers to hold the wire in the gap between the motor housing 19 and the shroud 35. In other embodiments, more than one wire could be attached to the inside of the shroud 35. The wire may have, for example, twists or coils to further disrupt laminar flow. In still other embodiments, the wire may be attached in two places near the inlet such that the wire forms a "horseshoe" shape inside the shroud. The wire may be used by itself or in conjunction with other means of flow disruption such as dimples 32 (FIG. 4) or irregularly shaped shrouds.

Figure 7:
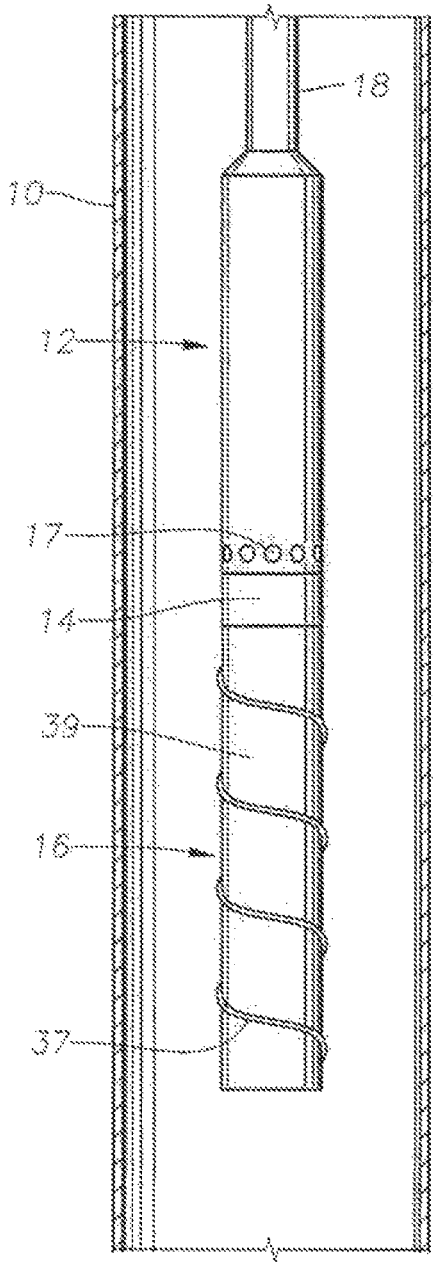
FIG. 7 is a sectional view of a pump assembly with a wire coil attached to the motor housing.

Referring to FIG. 7, the turbulator may be a wire coil 37 attached in helical fashion to the outside surface of the motor 39. The presence of the coil 37 serves to disrupt the laminar flow of the production fluid and thus increase the rate of heat transfer. The coil 37 can be installed in any variety of positions. For example, it could be looped around the motor 16 and attached directly to the motor housing 39, or it could use spacers to hold the wire at a distance from the motor housing 39. The wire may have, for example, twists or coils to further disrupt laminar flow. The wire may be used by itself without a shroud, or in conjunction with other means of flow disruption such as dimples 33 (FIG. 5) or irregularly shaped shrouds.

Figure 8:
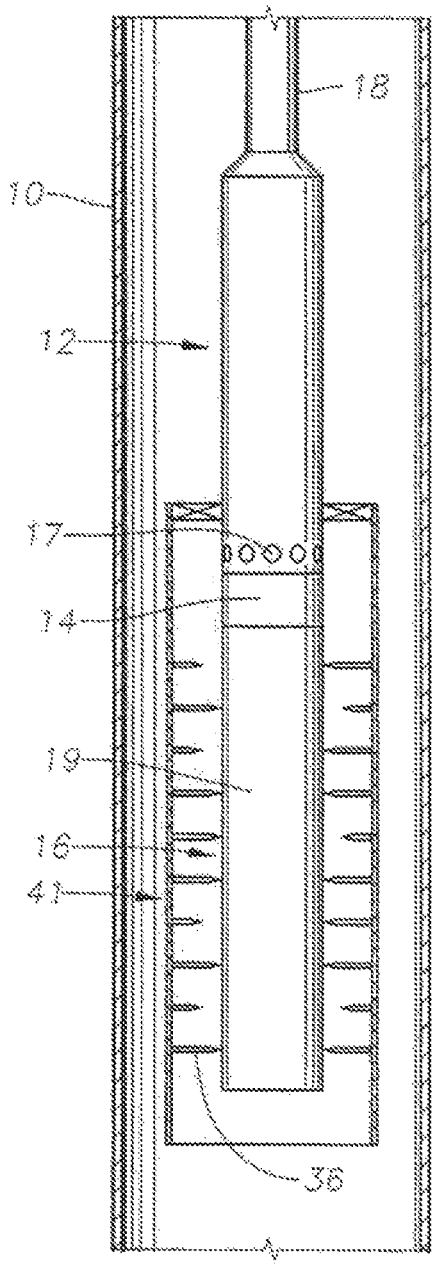
FIG. 8 is a sectional view of a pump assembly and shroud with screws protruding from the inside of the shroud.

Referring to FIG. 8, the turbulator comprises pins or screws 36 attached to the shroud 41 and extending radially inward to disrupt flow. The pins 36 may be, for example, ¼" diameter studs that could be installed by inserting them through holes drilled shroud 41 such that they protrude from the interior of the shroud 41. In other embodiments, screws 36 or bolts could be installed by screwing them through threaded holes tapped in the shroud 41. The pins or screws 36 may be held in place by a variety of means, including, for example, their own threads, bolts, welding, and the like. The pins or screws 36 may be distributed around the entire circumference and along the entire length of the shroud 41. The pins or screws 36 may be arranged in a symmetrical or in a random pattern. Furthermore, the pins or screws 36 may be used to disrupt flow in straight cylindrical shrouds or in irregularly shaped shrouds, as shown in FIGS. 2 and 3.

The pins or screws 36 serve to disrupt the laminar flow of the production fluid and thus increase the rate of heat transfer. In a preferred embodiment, the pins or screws 36 are inserted to a depth such that they contact or nearly contact the motor housing 19. By contacting or nearly contacting the motor housing 19, the pins or screws 36 create turbulence close to the motor and thus increase the rate of heat transfer. The user may insert the screws 36 or pins through the shroud 41 after the motor 16 is already installed in the shroud 41. This embodiment allows easy insertion of the motor 16, followed by installation of screws 36 that nearly contact the motor and the shroud 41. The screws 36 may be removed prior to removal of the motor 16 from the shroud 41, thus providing the heat transfer benefits of the screws 36 while still allowing for easy maintenance access. The pins or screws 36 may be used in combination with any other embodiment of invention, including irregularly shaped shrouds and dimples 32.

Figure 9:
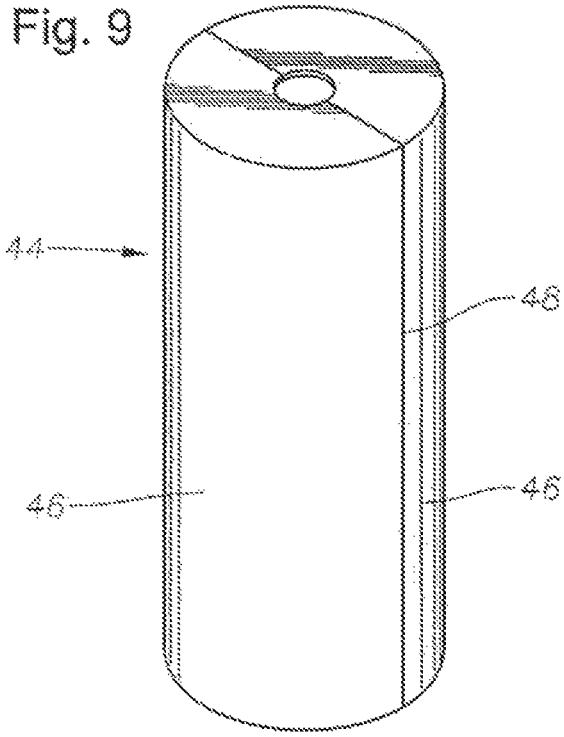
FIG. 9 is an orthogonal view of a clamshell shroud in which two halves of the clamshell are shown in the closed position.

Referring to FIG. 9, the shroud 44 may be split into two or more halves or pieces 46 that may be joined together around the motor 16 in a "clamshell" configuration. The joint 48 may be any variety of joint types, including flange, tongue-and-groove, dowel pin, and the like. The pieces 46 may be held together with bolts, quick release latches, interlocking pieces, and the like. The clamshell may divide the shroud 44 into two, three, or more segments or pieces 46. Each piece 46 may be a segment of a cylinder. One or more joints between the components may have a hinge. The clamshell design may be used to facilitate easier installation of the turbulators.

Figure 10:
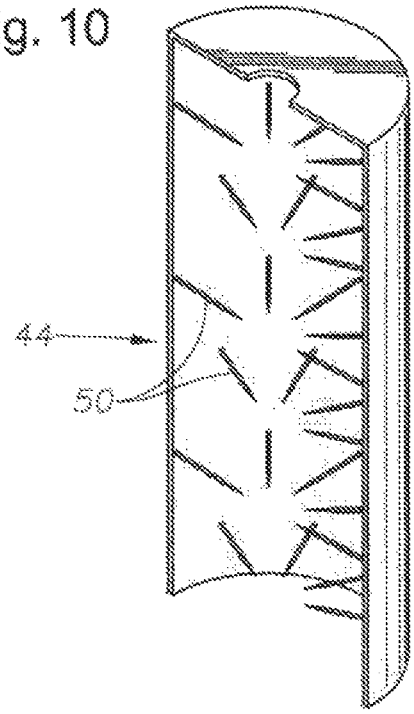
FIG. 10 is an orthogonal view of one half of a two-part clamshell shroud and pins in the clamshell.

Referring to FIG. 10, the clamshell shroud 44 overcomes the difficulty, for example, of installing and removing the motor 16 when other devices, such as pins 50, screws, fins 52, and the like are present between the motor and shroud 44. Separating the clamshell segments facilitates installation of objects located between the shroud 44 and the motor 16 by giving better access to the inside surface of the shroud 44. Furthermore, it is easier to manufacture irregularly shaped shrouds when the shroud 44 is split. It is easier, for example, because the pieces can be produced by metal-stamping rather than requiring extrusion, turning, or otherwise shaping a cylindrical object.

Figure 11:
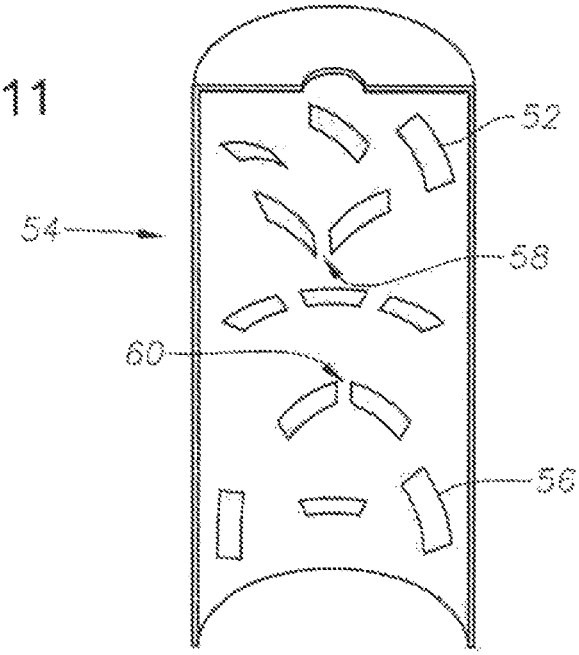
FIG. 11 is an orthogonal view of one half of a two-part clamshell shroud with fins.

Referring to FIG. 11, in one embodiment of the clamshell configuration, fins 52 may be installed on the motor housing 19 or the shroud 54, and the fins 52 may be so long in radial dimensions that they contact both components. A fin 52 could, for example, be welded to the shroud 54 and contact or nearly contact the motor housing 19 when the motor 16 is installed. This embodiment overcomes the inherent manufacturing and maintenance difficulties associated with attaching fins 52 directly to the motor housing 19, yet still creates turbulent flow immediately adjacent to the motor.

The fins 52 may be oriented in a variety of positions. In one embodiment, the fins 52 are attached at a 90 degree angle or normal in relation to the wall of the shroud 54. Fins 52 may be slanted in relation to the axis of the shroud 54, such as at a 45 degree angle. As illustrated by group 56 of fins 52, adjacent fins 52 may incline at the same inclination relative to the axis of shroud 54. Also, some of the adjacent fins 52 may slant at alternating angles to each other. For example, one fin 52 is slanted at a 45 degree angle in one direction, and the adjacent fin is slanted at an opposing 45 degree angle in the opposite direction, such that the bottom most edges 58 of the fins 52 are nearest each other and the fins diverge as they go up along the axis of the shroud. Other fins 52 may have the same 90 degree opposed orientation, but with the top most part 60 of the fins 52 nearest each other. The angle between opposed sets of fins 58 could be any angle. The fins 52 may be set at any variety of angles, and the fins need not be uniform in layout or in angles. In some embodiments, the fins join shroud 54 at an angle other than 90 degrees or normal relative to the surface of the shroud.

The various fin 52 configurations serve to disrupt the laminar flow of the production fluid as it flows past the motor housing 19 and shroud 54. In some embodiments, the flow develops swirling or vortexes. The fins 52 may be various lengths, including, for example, 1 to 3 inches long. The fins 52 may be attached to the clamshell shroud 54 by, for example, welding or adhesives before the halves of the clamshell 54 are joined.

While the invention has been shown or described in only some of its forms, it should be apparent to those skilled in the art that it is not so limited, but is susceptible to various changes without departing from the scope of the invention.

We claim:

1. An apparatus for pumping fluid from a well, comprising:
- a pump;
- a motor operably connected to the pump;
- a shroud surrounding the motor and creating an annular gap therebetween, the shroud having an annular sidewall defining a bore, the bore having a circular diameter that increases and decreases along the length of the shroud; and
- wherein the sidewall of the shroud comprises a plurality of first cylindrical segments of a first inner diameter and a plurality of second cylindrical segments of a second inner diameter, each of the first cylindrical segments joining and alternating with one of the second cylindrical segments along the length of the shroud.

2. The apparatus according to claim 1, wherein at least some of the cylindrical segments have different lengths than others of the cylindrical segments.

3. An apparatus for pumping fluid from a well, comprising;
- a pump;
- a motor operably connected to the pump;
- a shroud surrounding the motor and creating an annular gap therebetween, the shroud having an annular sidewall defining a bore, the bore having a circular diameter that increases and decreases along the length of the shroud; and
- wherein the sidewall of the shroud has annular undulations along the length, defining larger inner diameter portions alternating with smaller inner diameter portions.

4. The apparatus according to claim 3, wherein the annular undulations form a sinusoid configuration along the length of the shroud.

5. The apparatus according to claim 1 wherein a wall thickness of the sidewall of the shroud is constant along the length of the shroud.

6. An apparatus for pumping fluid from a wellbore, comprising:
- a pump,
- a motor connected to the pump, the motor having a housing with an exterior surface and a longitudinal axis,
- a shroud supported by the pump and surrounding and spaced from the exterior surface of the housing of the motor; and
- a plurality of cylindrical pins attached to and protruding inward from the shroud toward the motor, the pins being spaced circumferentially around and axially apart from each other along a length of the shroud.

7. The apparatus of claim 6, wherein at least some of the pins are in contact with the housing of the motor.

8. The apparatus of claim 6, wherein the pins comprise screws.

9. The apparatus of claim 6, wherein the shroud can be separated into at least two pieces, the shroud having a joint between the two pieces that is generally parallel to the longitudinal axis.

10. The apparatus according to claim 6, wherein at least some of the pins are located on radial lines.

11. A method for increasing heat transfer from a submersible well pump motor to a well fluid comprising:

(a) operably connecting the motor to a pump;

(b) installing a shroud surrounding the motor and creating a gap therebetween, the shroud having an annular interior surface to define a bore with a circular inner diameter, the inner diameter varying along the length of the shroud with larger inner diameter portions joining and alternating with smaller inner diameter portions;

(c) submerging the motor and pump in a well fluid;

(d) operating the motor to drive the pump, causing the well fluid to flow along an exterior of the motor; and (f) increasing turbulence of the flow of well fluid past the motor with the shroud.

12. The method according to claim 11, wherein the shroud has a plurality of pins attached to the shroud and protruding radially inward from the interior surface, relative to a longitudinal axis of the motor.

13. The method according to claim 11, wherein the shroud comprises a plurality of cylindrical segments joining each other and spaced axially along the axis of the motor, and wherein at least two of the cylindrical segments have a different circular inner diameter from each other.

14. The method according to claim 11, wherein the annular interior surface of the shroud undulates in a sinusoid.

* * * * *